US006193107B1

(12) United States Patent
D'Andrade

(10) Patent No.: US 6,193,107 B1
(45) Date of Patent: Feb. 27, 2001

(54) BLADDER WATER GUN

(75) Inventor: Bruce M. D'Andrade, Readington Township, Hunterdon County, NJ (US)

(73) Assignee: Larami Limited, Mount Laurel, NJ (US)

( * ) Notice: Subject to any disclaimer, the term of this patent is extended or adjusted under 35 U.S.C. 154(b) by 0 days.

(21) Appl. No.: 09/447,770

(22) Filed: Nov. 23, 1999

Related U.S. Application Data

(62) Division of application No. 09/245,668, filed on Feb. 8, 1999, now Pat. No. 6,012,609, which is a continuation of application No. 09/052,758, filed on Mar. 31, 1998, now Pat. No. 5,906,295, which is a continuation of application No. 08/672,942, filed on Jun. 28, 1996, now Pat. No. 5,758,800.

(51) Int. Cl.[7] ..... B65B 3/04

(52) U.S. Cl. ..... 222/79; 222/212; 417/474; 92/90

(58) Field of Search ..... 222/79, 206, 209, 222/212, 401; 446/405, 473; 417/412, 472, 474; 92/90, 93

(56) References Cited

U.S. PATENT DOCUMENTS

| | | | | |
|---|---|---|---|---|
| 2,237,678 | | 4/1941 | Lohr et al. . | |
| 3,151,706 | * | 10/1964 | Dillenburger et al. | 92/90 |
| 3,190,229 | * | 6/1965 | Turowski | 417/412 |
| 3,406,633 | | 10/1968 | Schomburg | 417/474 |
| 3,486,539 | | 12/1969 | Jacuzzi . | |
| 4,135,559 | | 1/1979 | Barnby . | |
| 4,212,460 | | 7/1980 | Kraft . | |
| 4,257,460 | | 3/1981 | Paranay et al. . | |
| 4,458,830 | | 7/1984 | Werding . | |
| 4,735,239 | | 4/1988 | Salmon et al. . | |
| 4,854,480 | | 8/1989 | Shindo | 222/79 |
| 4,867,208 | | 9/1989 | Fitzgerald et al. . | |
| 4,892,081 | | 1/1990 | Moorman . | |
| 4,991,847 | | 2/1991 | Rudell et al. . | |
| 5,088,522 | * | 2/1992 | Rath et al. | 417/474 |
| 5,336,051 | * | 8/1994 | Tamari | 417/412 |
| 5,373,833 | | 12/1994 | D'Andrade . | |

* cited by examiner

*Primary Examiner*—J. Casimer Jacyna
(74) *Attorney, Agent, or Firm*—Akin, Gump, Strauss, Hauer & Feld, L.L.P.

(57) ABSTRACT

The present invention is a toy water gun for containment and ejection of water which includes a housing, an ejection nozzle, a bladder and an outlet connection which runs from the bladder to the nozzle. The expandable bladder is located in the housing and has a first end connected to the outlet connection and has a carriage attachment located at the second end. The bladder carriage attachment is movable and guided generally linearly in the housing as the bladder is expanded. The bladder is a tubular member having a weakened section with a larger diameter than the remaining portion of the tubular member and has a variable diameter which varies from larger at the first end to smaller at the second end. In one embodiment, the bladder has a variable diameter, larger at it's front end and smaller at it's back end. In another embodiment, the bladder has a constant diameter with a wall thickness gradient. Combined variable diameters and wall thickness may be used.

6 Claims, 5 Drawing Sheets

BLADDER WATER GUN

CROSS-REFERENCE TO RELATED APPLICATIONS

This application is a divisional of U.S. patent application Ser. No. 09/245,668, filed Feb. 8, 1999, now issued as U.S. Pat. No. 6,012,609, which is a continuation of U.S. patent application Ser. No. 09/052,758, filed Mar. 31, 1998, now issued as U.S. Pat. No. 5,906,295, which is a continuation of U.S. patent application Ser. No. 08/672,942, filed Jun. 28, 1996, now issued as U.S. Pat. No. 5,758,800.

BACKGROUND OF THE INVENTION

1. Field of the Invention

The present invention is directed to bladders for use in toy guns wherein the bladders are expanded and filled with water and then the expanded bladder becomes the driving force for ejection of the water when the gun is "fired." More specifically, the bladders of the present invention have specific features which permit controlled expansion and subsequent, predictable contraction and water ejection upon release.

2. Information Disclosure Statement

The following patents represent development in bladder-containing toy guns (air and water) as well as other water guns:

U.S. Pat. No. 5,373,833 to D'Andrade describes a projectile-shooting air gun. It includes a main housing which has a barrel adapted for receiving a projectile, a handle and a trigger, as well as a high pressure, inflatable bladder connected to the main housing, the bladder has a inlet and an outlet. There is also a pressurizing mechanism for providing air pressure to the bladder to inflate it. The pressurizing mechanism is physically connected to the housing and functionally connected to the bladder inlet. There is a bladder deflation valve having an upstream side and a downstream side, and it is connected to the bladder outlet at the valve's upstream side, and is connected to the trigger for opening and closing thereof, and is connected to a projectible launch tube at the valve's downstream side for launching a projectile upon deflation of at least a portion of the bladder when it has been inflated. The launch tube is located in the barrel of the main housing and connected to the downstream side of the bladder deflation valve, and adapted for receiving and shooting a projectile. In preferred embodiments, the bladder has a predetermined expansion size to which it is capable of being inflated, and an enclosure is provided around the bladder, which is a size less than the predetermined expansion size to enhance a controlled pressurization of the bladder during inflation and deflation.

U.S. Pat. Nos. 4,991,847 and 4,890,838 to Rudell et al. both describe a timed water release toy. There is disclosed a ball having a foraminous outer shell with an inner membrane which forms an interior closure within the outer shell and with a timer and a release mechanism operative to open the inner membrane and release its contents after the time on the timer expires. The contents spill through the foraminous outer shell, wetting the player who is handling or catching the ball at the moment of release. The timer is activated and the ball is used in a game in which it is tossed between participants who seek to avoid becoming wet when the timer releases the water from the interior closure of the ball.

U.S. Pat. No. 4,892,081 Randall Morrmann sets forth a compressible ball launcher which relies upon a telescoping cylindrical gun to compress air to force a ball out of a nozzle.

U.S. Pat. No. 4,867,208 describes an apparatus capable of storing and expelling a large quantity of fluid, having an elastic hollow tube having an open end through which fluid may be inserted into and expelled out of the tube. There is a hollow elongate outer enclosure surrounding the tube, and a slidable inner sleeve located between the tube and the outer enclosure. The inner sleeve slides through the outer tube upon contact by the tube as the tube axially expands, thereby preventing crimping of the tube.

U.S. Pat. No. 4,854,480 to Shindo describes a long range trigger-actuated squirt gun. The squirt gun includes a hollow housing in the form of a gun with a liquid dispensing assembly within the housing. The liquid dispensing assembly includes a rubber tube, expandable upon being filled with liquid, which is connected to a rigid tube with a nozzle at one end, and will dispense liquid from the rubber tube through the nozzle. A pivotable trigger is mounted with one end located to squeeze the rubber tube against the housing. A rigid coil around the rubber tube between the trigger and rigid tube restrains the rubber tube from expansion for the length of the coil. An adapter is provided which is threadable on a faucet, for filling the rubber tube in the squirt gun with water.

U.S. Pat. No. 4,735,239 to Salmon et al. describes a liquid projecting device. The device uses an elastic tubular bladder for receiving liquid which is expandable radially generally spherically at a local segment until a fully-expanded cross-section is achieved at which time the expanded region begins to grow axially, thereby maintaining a relatively constant pressure independent of bladder volume. The device is provided with a nozzle and a valve for controlling and directing the flow of the projected liquid.

U.S. Pat. No. 4,458,830 to Werding describes an appliance for discharging a non-compressible liquid, creamy or pasty product under pressure. The container of rigid material comprises an appliance which employs the contractional force of an expanded rubber hose and an expanded product container for the discharge of a medium stored therein. A hollow body of elastic material located in the axis of a product container is provided with a valve at on end through which it is inflated. The shape of the inner walls for the rigid container limits a radial, diagonal-radial and axial expansion of the appliance in a predetermined ratio, whereby the medium acts upon the inflated hollow body in such a way that the volume of the latter decreases, whereby its inner pressure increases and gives it a tendency to expand. If the squeezing pressure exerted by the rubber hose and the product container upon the medium decreases, the hollow body can expand accordingly and thus compensate the loss of contraction pressure.

U.S. Pat. No. 4,257,460 to Paranay et al. describes a water gun. The novel water gun is disclosed herein having a body formed with a central bore opening at its opposite ends to provide a discharge nozzle at one end of the body and a storage compartment or reservoir end at the opposite end of the body. The storage compartment end is adapted to releasably hold the end of an inflatable member which when loaded with water under pressure, expands so as to stretch the membrane of the inflatable storage compartment. Upon termination of the loading pressure, the inflatable member collapses under its own elasticity to discharge the stored water via the nozzle end of the body. A clamping device is employed for detachable connection gate inflatable storage compartment to its respective end of the body and a trigger mechanism may be employed for selectively releasing the pressurized water within the storage compartment.

U.S. Pat. No. 4,212,460 to Kraft describes a hollow water-filled game toy. The hollow body is provided having two complementary parts releasably joined about interfitting rim portions. When the parts are joined, the hollow body may be compressed to partially deform a portion of the rim structure into an opening thereby allowing the filling of water into the body interior. After deformation the parts resume their original shape. An effective hermetic seal to retain the water within the interior is formed by squeezing the body and purging air through the vents in the rim portions. The water-filled body may then be thrown against a stationary object whereby the force of impact will release the seal and allow the water to become suddenly released causing a splashing action. The complementary hollow parts may be subsequently rejoined and refilled with water to repeat the throwing and splashing action.

U.S. Pat. No. 4,135,559 to Barnby describes a water squirt toy and fill valve combination. The water squirt toy apparatus includes a combination of a water squirt toy and a special filling valve which function together cooperatively. The water squirt toy includes a resiliently expansible tubular member serving as a water reservoir and encased within a rigid tubular support member, and a manually operated, lever-type normally closed valve mechanism operatively associated with the expansible member for permitting or preventing fluid discharge therefrom by compressing or pinching the same. The frontward end of the expansible member is fixedly, but removably, secured to a discharge opening. The filling valve is particularly structured for fluidically mating with a conventional hose bib or hose as well as with the discharge opening in order to permit easy and rapid filling and refilling of the expansible member with water. The discharge opening may also mate directly with the hose bib or hose without the special valve. An injector is also provided for operative connection to the filling valve for injecting chemicals in to the water supply whereby the discharged streams will coalesce and exhibit reduced separation so as to be discharged over significantly greater distances; and amusement apparatus which is particularly adaptable for use with the water squirt toy is also disclosed. A weakened annular portion of the tubular member is utilized to insure that the expansion begins frontward and progresses rearwardly.

U.S. Pat. No. 3,486,539 to Candido Jacuzzi describes a liquid dispensing and metering assembly. The liquid dispensing and metering assembly in which an expansible receptacle of a material adapted to maintain constant pressure characteristics over a substantial change in volume of liquid content of such receptacle, discharges through a slow rate metering-element to provide a uniform discharge flow at a low constant pressure.

U.S. Pat. No. 2,237,678 issued to Raymond Lohr et al describes a repeating, cork shooting toy which utilizes a cork magazine which rotates after each firing to position the next cork in sequence for firing.

Notwithstanding the foregoing, the prior art neither teaches nor suggests the use of the unique bladders in water guns, as in the present invention.

SUMMARY OF THE INVENTION

The present invention is a toy water gun for containment and ejection of water which includes a housing, an ejection nozzle, a bladder and an outlet connection which runs from the bladder to the nozzle. The expandable bladder is located in the housing and has a first end connected to the outlet connection and has a carriage attachment located at the second end. The bladder carriage attachment is movable and guided generally linearly in the housing as the bladder is expanded. The bladder is a tubular member having a weakened section with a larger diameter than the remaining portion of the tubular member and has a variable diameter which varies from larger at the first end to smaller at the second end.

In one embodiment, the bladder has a variable diameter, larger at its front end and smaller at its back end. In another embodiment, the bladder has a constant diameter with a wall thickness gradient. Combined variable diameters and wall thicknesses may be used.

BRIEF DESCRIPTION OF THE DRAWINGS

The present invention is more fully understood when the present specification is taken in conjunction with the drawings appended hereto, wherein.

DETAILED DESCRIPTION OF THE PRESENT INVENTION

Figure 1:
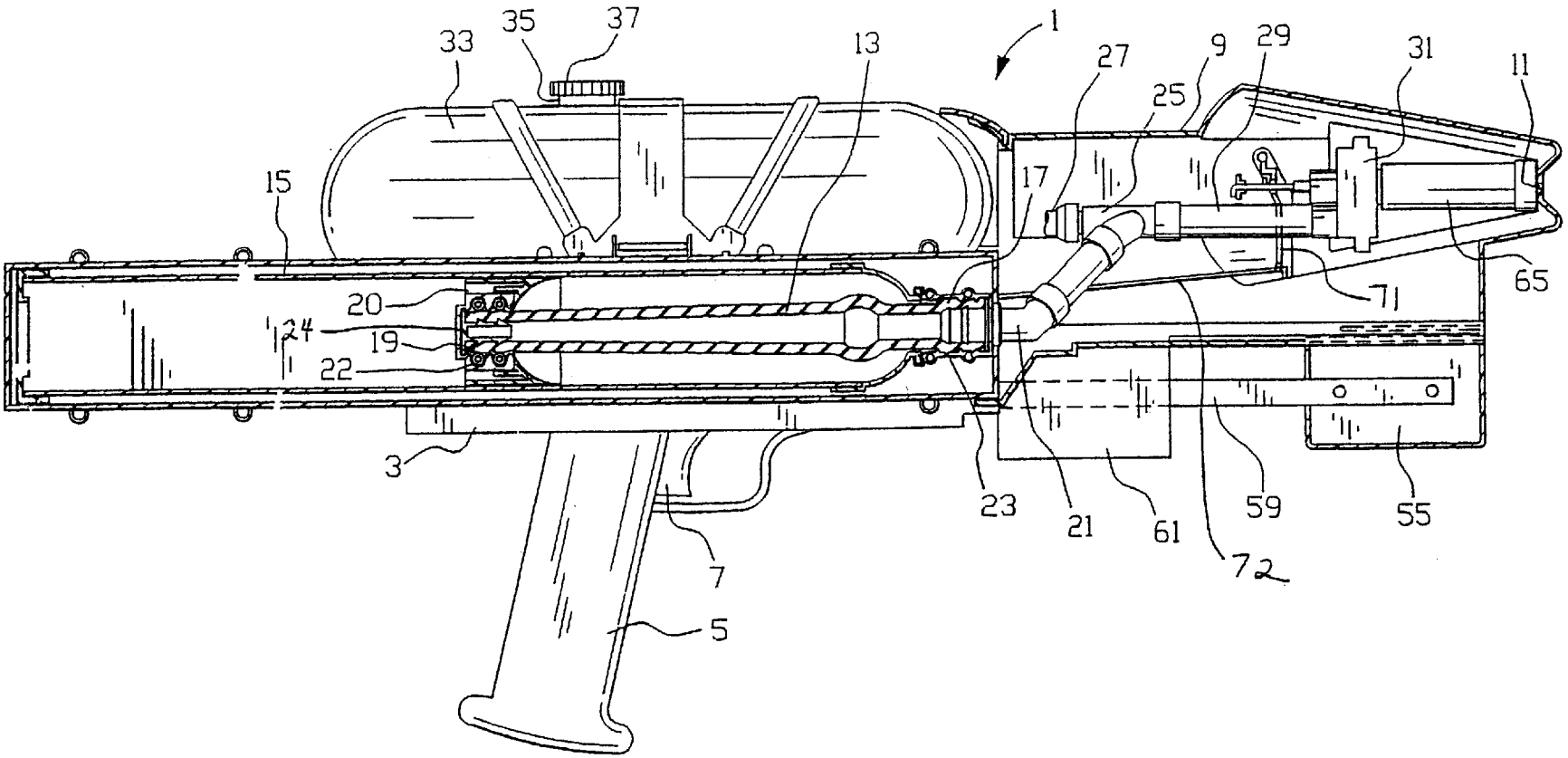
FIG. 1 shows a side cut view of a toy water gun utilizing a present invention bladder.

Referring now to FIG. 1, the operation of the present invention embodiment can best be explained. FIG. 1 is a side view of the present invention embodiment toy water gun 1 with main housing 3, handle 5, trigger 7 and barrel 9 with nozzle 11.

Bladder 13 is located within enclosure 15. Bladder 13 has a front end 17 and back end 19 and is cylindrical, but could be of another shape and not exceed the scope of the present invention. Front end 17 acts both as an inlet and an outlet in this embodiment, but the water gun could be configured so that back end 19 acts as the outlet or vice versa. Back end 19 includes clamp 22 and also includes bladder carriage 20 surrounding clamp 22. Clamp 22 holds plug 24 in the back end 19 of bladder 13 and connects back end 19 of bladder 13 to bladder carriage 20. Bladder carriage 20 moves towards the back of the gun as bladder 13 is expanded (filled) and moves back to its rest position (shown in FIG. 1) during release of the bladder. Front end 17 has tube 21 connected thereto via clamp 23. Tube 21 is connected to a "y" connection 25 which is connected to tube 27, which is connected to a pump, described below. Connection 25 is also connected to tube 29 which is connected to a bladder release valve 31, discussed below.

Figure 2:
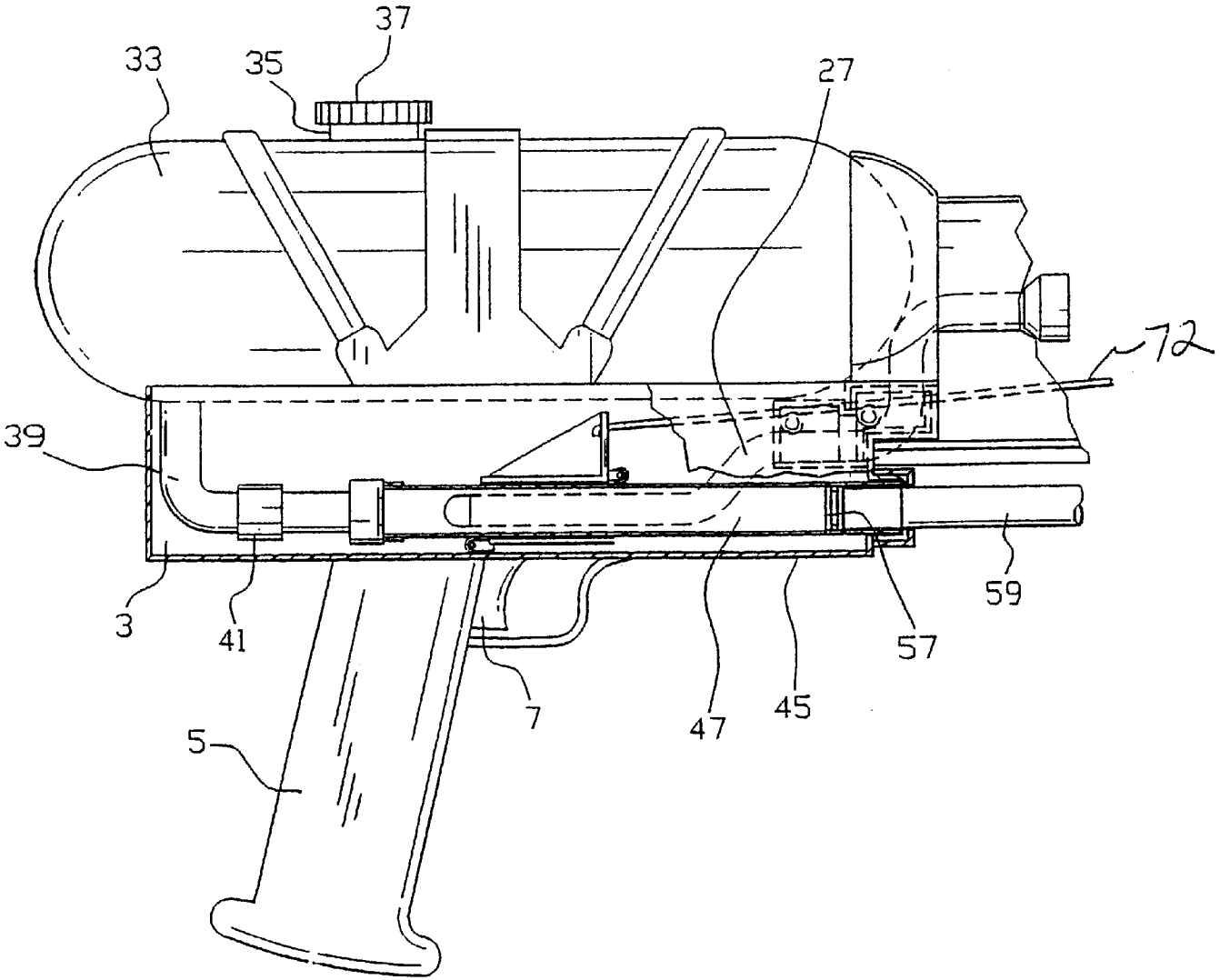
FIG. 2 shows a partial side cut view of the toy water gun shown in FIG. 1 with the present invention bladder removed for presentation of the pump.

The operation of present invention toy water gun 1 is illustrated by reference to both FIGS. 1 and 2 simultaneously, with identical parts for both figures being identically numbered. FIG. 2 shows a partial side cut view, with the bladder 13 and related housing removed to show pump 45 and its operation. Toy water gun 1 is operated by filling or partially filling tank 33 with water through fill port 35 after removal of cap 37. Tank 33, as shown, is connected to water gun main housing 3, as shown. By "connected" is means physically or fluidly connected to the gun directly or indirectly or internally contained therein or integrally formed therewith. Cap 37 has a small vent hole (not shown) to allow air entry but to discourage water leakage to prevent a vacuum from being formed in tank 33. Tank-to-pump tube 39 is connected to pump 45 and includes one-way valve 41 which permits water to enter into pump cylinder 47, but not back into tank 33. Movement of the piston 57 within the pump cylinder 47 forces movement of water to bladder 13 from tank 33. The piston 57 is operated by the pump rod 59 that connects the piston 57 to the slider handle 55. The pump rod 59 is anchored to the slider handle 55 and is slideably held in place by block 61.

The slider handle 55 is operated manually by the user. The user holds the slider handle 55 with one hand and the gun handle 5 with the other. The slider handle 55 is then moved back and forth along the length of its path, with block 61 acting as a stop. The back and forth action is transferred to the piston 57, which draws water from tank 33 through tubing 39 and past one-way flow valve 41, into cylinder 47 on the outward stroke. On the inward stroke, water in cylinder 47 is forced (or pumped) through tubing 27, through "y" connection 25, into tubing 21 and into the bladder 13 for expansion and filling thereof. Water is pumped to the bladder 13 via pump 45 until the bladder 13 is filled. Water will also enter tube 29, but will not eject through the outlet tubing 65 and nozzle 11 because release valve 31 will be closed until trigger 7 is pulled. Once under expansion, the water is bladder 13 is prevented from flowing freely through the outlet tubing 65 by valve 31.

Figure 3:
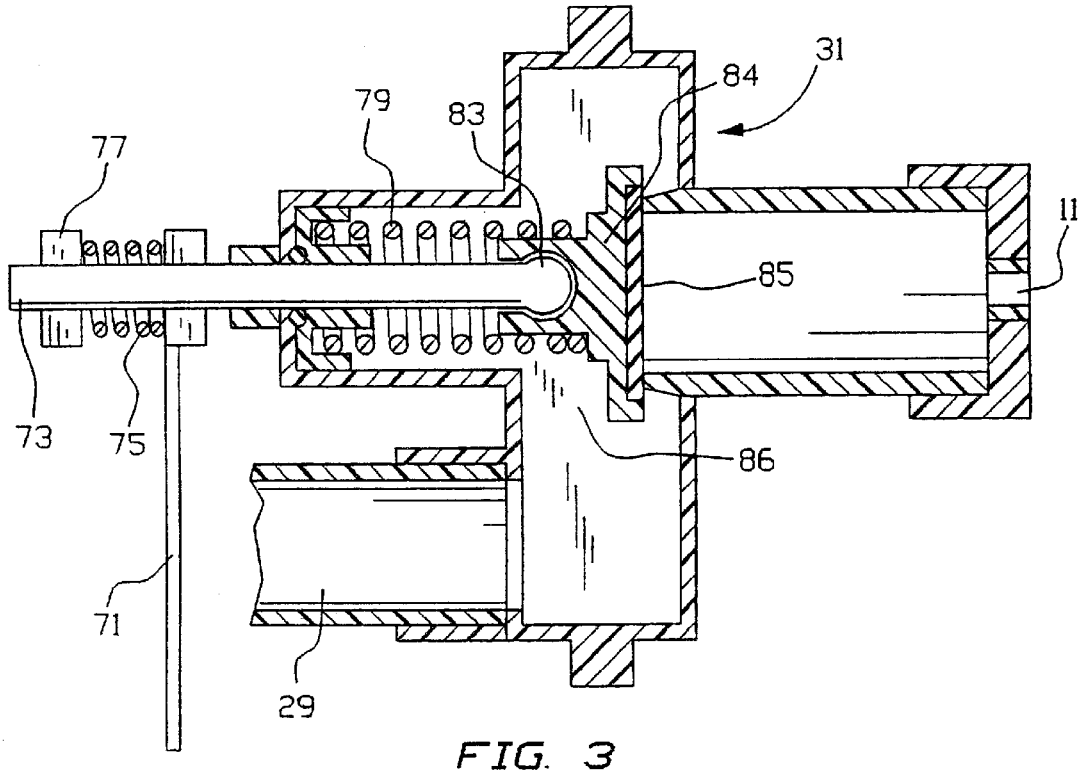
FIG. 3 shows a side cut view of a bladder release valve which may be used in the toy water gun shown in FIGS. 1 and 2.

Referring now to FIG. 3, taken in conjunction with FIGS. 1 and 2 with identical parts being identically numbered, details of release valve 31 are shown in a side cut view. Linkage trigger riser 71 is connected to trigger 7 via linkage 72 (FIGS. 1 and 2) and is slidably attached to pull rod 73. Spring 75 and stop 77 work in conjunction with trigger riser 71. Stop 77 is securely attached to pull rod 73. Pull rod 73 has at its opposite end a flexible connection universal ball connector 83. This is slightly rotatable within valve plug 84. When the trigger 7 is pulled, linkage 72 causes trigger riser 71 to compress spring 75 to the left and pushes on stop 77 to move pull rod 73 and valve plug 84 with valve seal 85 to the left. However, spring 79 and water pressure within chamber 86 apply forces which tend to maintain valve plug 84 and valve seal 85 in the closed, sealed position. When sufficient squeeze pressure is applied to the trigger, spring 75 pushes stop 77 to the left, thereby, valve plug 84 and valve seal 85 are snapped to the left for rapid release and ejection of water motivated by compressive forces of the water-filled bladder 13. This creates the desired blasting effect and enhances the rate and distance of the ejected water.

Figure 4:
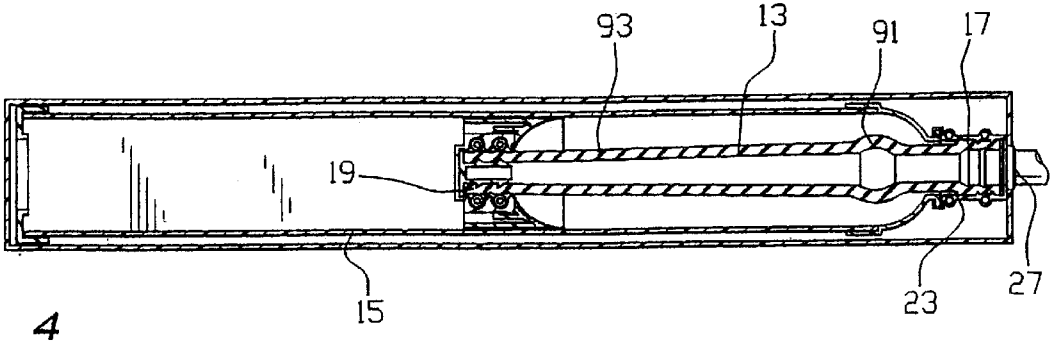
FIGS. 4 through 6 show partial side cut views of a present invention enclosure and bladder for toy water gun usage wherein the bladder is shown in various expansion stages.
Figure 5:
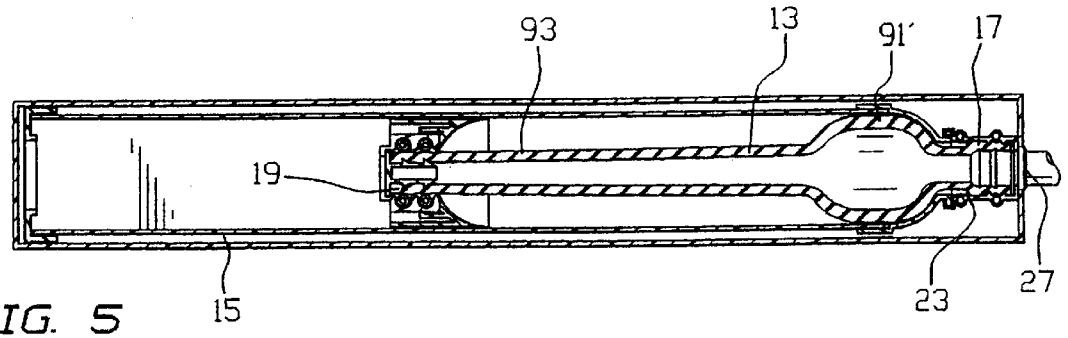
Figure 6:
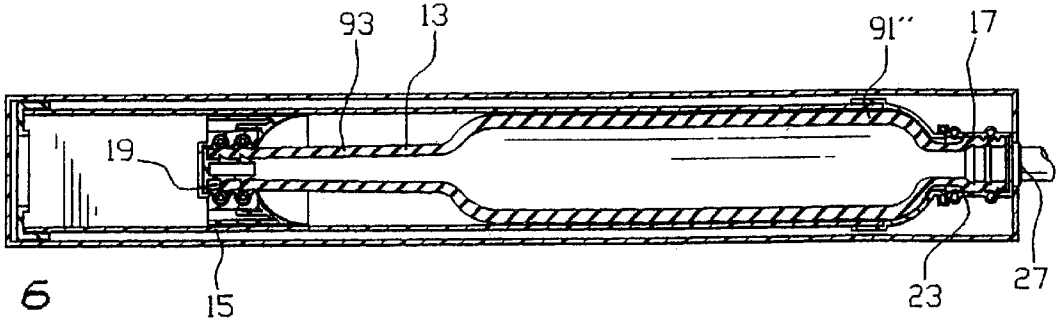

FIGS. 4 through 6 show side, partially cut, simplified views of a present invention toy water gun bladder 13 in various states of expansion. In this preferred embodiment arrangement, the bladder 13 has a predetermined inflated size and enclosure 15 has a size less than that predetermined fully expanded size.

In FIG. 4, bladder 13 is shown in its rest (unfilled, unexpanded) position, with identical parts being identically numbered, but with more bladder 13 detail shown. The bladder 13 includes a preformed "bubble" portion 91, which is weaker than the rest of the bladder and thus enhances expansion at that location. The bladder 13 preferably includes wall 93 which is tapered in the unexpected state, with the wall having a smaller diameter towards back end 19 and a larger diameter towards bubble 91 and front end 17. The smaller diameter section requires more pressure to expand than the larger diameter section. Thus, expansion starts at the bubble 91 and progresses towards the back end 19. The bladder 13 first expands radially and then expands longitudinally to provide a more constant rate of flow when released.

Enclosure 15 acts as a bladder guide and limits expansion of the bladder 13 to prevent bursting and to support water weight. The enclosure 15 may be described relative to air pressurization of the bladder. For example, in the preferred embodiment, the bladder 15's uninflated diameter may be three quarters of an inch, and fully inflated with 25 psig, it may have a four inch diameter. The total size or volume of the bladder is based on the bladder length. Enclosure 15 may have a diameter of, for example, three and one half inches. This enclosure restricts over expansion and helps to cause expansion and release to occur with consistency. Thus, in FIG. 4, bladder 13 is at rest. In FIG. 5, there is water pressure applied to cause initial expansion. This is created by the force of pump 45 pushing water into the bladder 13. First, bubble 91 is expanded as bubble 91', shown in FIG. 5, and expansion occurs first of the outlet end 17 and does so radially. Next, as more water is added, the bladder 13 will expand laterally down the enclosure 15 at a fixed pressure and rate, as shown as expanded portion 91" in FIG. 6. Likewise, the contraction of the bladder 13 will cause the release of water, and at a relatively constant pressure for a constant rate of ejection will be achieved.

Figure 7:
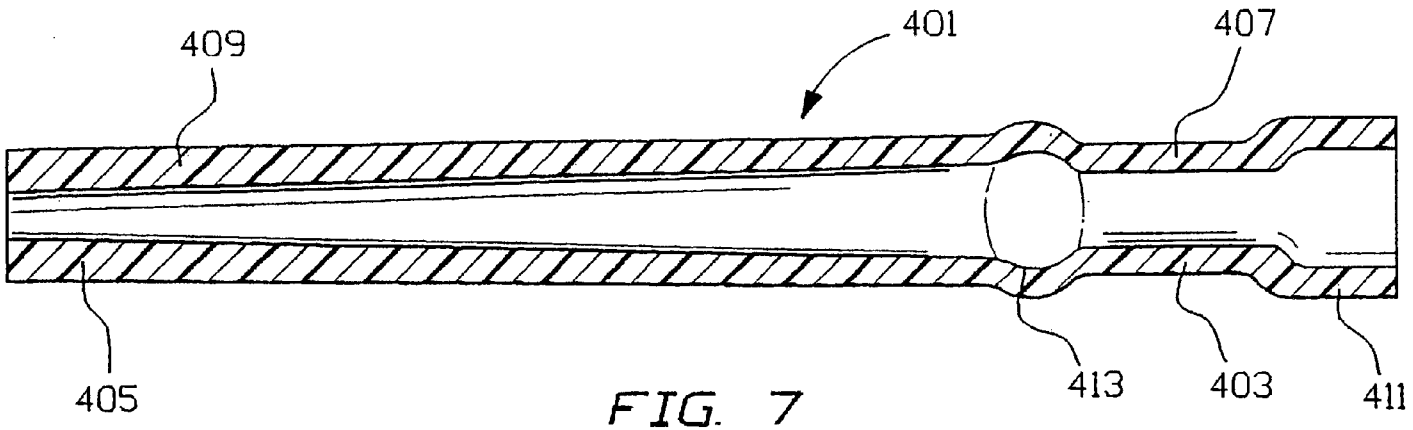
FIG. 7 shows a side cut view of an embodiment of a present invention bladder, which relies upon increasing wall thicknesses; and, FIG. 8 shows a side cut view of another embodiment of a present invention bladder which relies upon variable diameter.

FIG. 7 illustrates a present invention bladder 401 which is a hollow tubular member 403. It has a first end 411 and a second end 405. Located in the area of first end 411 is a weakened section 413. Here, weakened section 413 is in the general shape of a bubble, but could be otherwise shaped without exceeding the scope of the invention, e.g. an enlarged elongated or ovoid shape. This is the starting or initiating expansion point described in conjunction with FIG. 4 above. Also, the tubular member 403 has a unique shape developed to encourage expansion, first, radially at weakened section 413, and then lengthwise from right to left (from first end 411 to second end 405). In this embodiment, bladder 401 has a thicker wall 409 at second end 405 and a thinner wall 407 at first end 411. First end 411 also has an expanded neck, as shown, for fitting over an inlet/outlet tube and, when attached as such, has no bearing on the foregoing.

Figure 8:
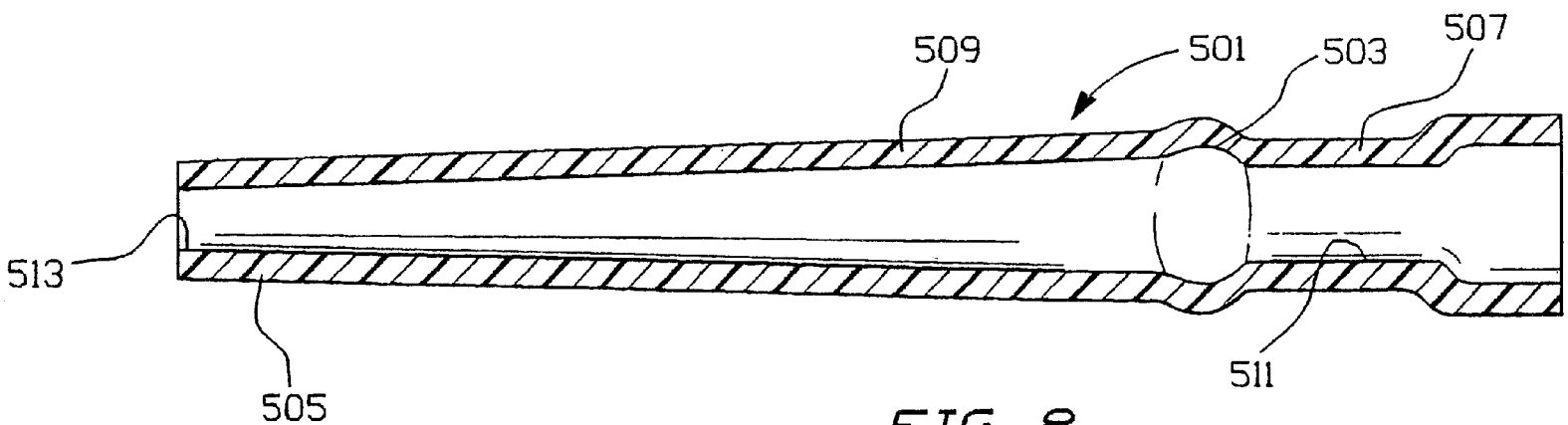

FIG. 8 shows an alternative bladder 501, with weakened section 503, first end 507 and second end 505. Here, tubular member 509 has a tapered (variable) diameter with a larger diameter 511 at first end 507 and a smaller diameter 513 at second end 505. Combinations of variable wall thicknesses shown in FIG. 7 and variable diameters shown in FIG. 8 may alternatively be used.

Obviously, numerous modifications and variations of the present invention are possible in light of the above teachings. It is therefore understood that within the scope of the appended claims, the invention may be practiced otherwise than as specifically described herein.

What is claimed is:

1. An improved bladder for liquid containment and ejection wherein the elasticity of the bladder becomes the motive force for liquid ejection, the improvement which comprises:

a hollow, elastic elongated tubular member having a first end and a second end, said first end having a section of weakened elastic strength relative to the remainder of said tubular member, said weakened section having a larger diameter than the remaining said tubular member, and said tubular member also having a variable diameter from larger at the first end to smaller at the second end in a taper and with a constant wall thickness, thus enhancing expansion at the larger diameter fist and then enhancing progressive expansion from the first end to the second end.

2. The bladder of claim 1 wherein the initial weaker section includes a bubble shape.

3. The bladder of claim 2 wherein said bladder has an attachment to the end of the bladder which secures the second end of said bladder and said attachment travels longitudinally along said tubular housing as bladder expands and until it reaches a predetermined stop.

4. The bladder of claim 1 wherein the elasticity of the material is such that it expands radially first and then longitudinally.

5. The bladder of claim 4 wherein said bladder is enclosed in a tubular housing which limits expansion both axially and longitudinally.

6. The bladder of claim 1 wherein said first end has an end portion which has an enlarged diameter relative to the remainder of said tubular member for attachment to an inlet/outlet tube.

* * * * *